US006719049B2

(12) United States Patent
Sherwood et al.

(10) Patent No.: US 6,719,049 B2
(45) Date of Patent: Apr. 13, 2004

(54) FLUID SAMPLING METHODS AND APPARATUS FOR USE IN BOREHOLES

(75) Inventors: John D. Sherwood, Cambridge (GB); John B. Fitzgerald, Cambridge (GB); Bunker M. Hill, Sugar Land, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 10/155,577

(22) Filed: May 23, 2002

(65) Prior Publication Data

US 2003/0217845 A1 Nov. 27, 2003

(51) Int. Cl.[7] ..... E21B 47/10; G01V 3/18

(52) U.S. Cl. ..... 166/264; 166/252.5; 73/152.18

(58) Field of Search ..... 166/252.5, 55, 166/55.1, 264, 100, 162, 321, 250.17, 152.01, 152.03, 152.05, 152.08, 152.18, 152.23

(56) References Cited

U.S. PATENT DOCUMENTS

| | | | | |
|---|---|---|---|---|
| 3,121,459 A | | 2/1964 | Van Ness, Jr. et al. | |
| 3,323,361 A | | 6/1967 | Lebourg | |
| 3,430,711 A | | 3/1969 | Taggart | |
| 3,611,799 A | | 10/1971 | Davis | |
| 3,924,463 A | * | 12/1975 | Urbanosky | 73/152.25 |
| 3,934,468 A | | 1/1976 | Brieger | |
| 4,246,782 A | | 1/1981 | Hallmark | |
| 4,287,946 A | | 9/1981 | Brieger | |
| 4,339,948 A | | 7/1982 | Hallmark | |
| 4,369,654 A | | 1/1983 | Hallmark | |

(List continued on next page.)

FOREIGN PATENT DOCUMENTS

| | | |
|---|---|---|
| WO | 96/30628 | 10/1996 |
| WO | 00/43812 | 7/2000 |

OTHER PUBLICATIONS

Mullins et al Real–Time Determination of Filtrate Contamination During Openhole Wireline Sampling by Optical Spectroscopy SPE 63071, 2000 SPE Annual Technical Conference and Exhibition, Dallas, Texas, Oct. 1–4, 2000.

Akram et al A Model to Predict Wireline Formation Tester Sample Contamination SPE 48959, 1998 SPE Annual Technical Conference and Exhibition, New Orleans, Louisiana, Sep. 27–30, 1998.

Hashem et al Determination of Producible Hydrocarbon Type and Oil Quality in Wells Drilled With Synthetic Oil–Based Muds SPE Reservoir Evaluation and Engineering, vol. 2 No. 2, Apr. 1999, pp. 125–133.

Hammond One– and Two–Phase Flow During Fluid Sampling by a Wireline Tool Transport in Porous Media, vol. 6, 1999, pp. 299–330.

Schlumberger Wireline Formation Testing and Sampling Schlumberger Wireline & Testing, 1996, pp. 4–1 to 4–47, 9–8 to 9–11 and 10–1 to 10–25.

*Primary Examiner*—Frank Tsay
(74) *Attorney, Agent, or Firm*—William L. Wang; William B. Batzer; John J. Ryberg

(57) ABSTRACT

The invention concerns a method of sampling the formation fluids in an earth formation surrounding a borehole, the region of the formation immediately surrounding the borehole being at least partially invaded by borehole fluids, and an apparatus for carrying out such a method. According to the invention, a borehole tool is adapted to be lowered into the borehole and is provided with a sampling probe device and means for urging the sampling probe device into contact with the borehole wall, the sampling probe device comprising an inner probe and an outer probe surrounding the inner probe for withdrawing respective fluid samples from the formation, wherein the ratio between the respective flow areas of the inner and outer probes is selected so as to tend to reduce the time taken to obtain via the inner probe a sample of the formation fluids having a given level of contamination by borehole fluids.

22 Claims, 6 Drawing Sheets

U.S. PATENT DOCUMENTS 4,392,376 A 7/1983 Lagus et al.
4,416,152 A 11/1983 Wilson
4,513,612 A * 4/1985 Shalek ..... 73/152.24
4,860,581 A 8/1989 Zimmerman et al.
4,879,900 A 11/1989 Gilbert
4,936,139 A 6/1990 Zimmerman et al.
4,994,671 A 2/1991 Safinya et al.
5,230,244 A 7/1993 Gilbert
5,335,542 A * 8/1994 Ramakrishnan et al. . 73/152.08
5,337,838 A 8/1994 Sorensen
5,765,637 A 6/1998 Dietle et al.
5,770,798 A 6/1998 Georgi et al.
5,934,374 A 8/1999 Hrametz et al.
6,176,323 B1 1/2001 Weirich et al.
6,178,815 B1 1/2001 Felling et al.
6,223,822 B1 5/2001 Jones
6,230,557 B1 5/2001 Ciglenec et al.
6,301,959 B1 10/2001 Hrametz et al.
6,568,487 B2 * 5/2003 Meister et al. ..... 175/50

* cited by examiner

FLUID SAMPLING METHODS AND APPARATUS FOR USE IN BOREHOLES

FIELD OF THE INVENTION

This invention relates to fluid sampling methods and apparatus for use in a borehole in an earth formation, for obtaining samples of the formation fluids in the earth formation.

BACKGROUND OF THE INVENTION

When a borehole is drilled into an earth formation in search of hydrocarbons, the borehole is typically filled with borehole fluids, primarily the re-circulating drilling fluid, or "drilling mud", used to lubricate the drill bit and carry away the cuttings. These borehole fluids penetrate into the region of the formation immediately surrounding the borehole, creating an "invaded zone" that may be several tens of centimetres in radial extent.

When it is subsequently desired to obtain a sample of the formation fluids for analysis, a tool incorporating a sampling probe is lowered into the borehole (which is typically still filled with borehole fluids) to the desired depth, the sampling probe is urged against the borehole wall, and a sample of the formation fluids is drawn into the tool. However, since the sample is drawn through the invaded zone, and the tool incorporating the sampling probe is still surrounded by borehole fluids, the sample tends to become contaminated with borehole fluids from the invaded zone, and possibly even from the borehole itself, and is therefore not truly representative of the formation fluids.

One way of addressing this problem is disclosed in International Patent Application No. WO 00/43812, and involves using a sampling probe having an outer zone surrounding an inner zone, fluid being drawn into both zones. The outer zone tends to shield the inner zone from the borehole fluids surrounding the tool embodying the sample probe, and thus makes it possible to obtain a relatively uncontaminated sample of the formation fluids via the inner zone.

However, the time taken to obtain a large enough sample having a given relatively low level of contamination can vary widely in dependence on borehole conditions. It is therefore an object of the present invention in some of its aspects to alleviate this problem.

SUMMARY OF THE INVENTION

According to a first aspect of the present invention, there is provided a method of sampling the formation fluids in an earth formation surrounding a borehole, the region of the formation immediately surrounding the borehole being at least partially invaded by borehole fluids, using a borehole tool which is adapted to be lowered into the borehole and which is provided with a sampling probe device and means for urging the sampling probe device into contact with the borehole wall, the sampling probe device comprising an inner probe and an outer probe surrounding the inner probe for withdrawing respective fluid samples from the formation, wherein the ratio between the respective flow areas of the inner and outer probes is selected so as to tend to reduce the time taken to obtain via the inner probe a sample of the formation fluids having a given level of contamination by borehole fluids.

The selecting step is preferably performed in dependence upon at least one parameter selected from the radial depth of the invaded region of the formation around the borehole, the ratio between the viscosity of the borehole fluids which have invaded the formation and the viscosity of the formation fluids, and the permeability and the anisotropy of the formations.

In one implementation of the first aspect of the invention, the selecting step comprises adapting the tool to receive interchangeable sampling probe devices, and choosing the sampling probe device from among a plurality of sampling probe devices each having a different value of said ratio. In another implementation of the invention, the selecting step comprises adapting the sampling probe device to receive interchangeable inner probes, and choosing the inner probe from among a plurality of inner probes each having a different flow area.

According to a second aspect of the invention, there is provided apparatus for implementing the method of the first aspect of the invention, the apparatus comprising a borehole tool adapted to be lowered into a borehole, the tool being adapted to receive any one of a plurality of interchangeable sampling probe devices and including means for urging a received sampling probe device into contact with the borehole wall, each sampling probe device comprising an inner probe and an outer probe surrounding the inner probe for withdrawing respective fluid samples from the formation, the ratio between the respective flow areas of the inner and outer probes being different for each sampling probe device.

According to a third aspect of the invention, there is provided another apparatus for implementing the method of the first aspect of the invention, the apparatus comprising a borehole tool which is adapted to be lowered into a borehole and which is provided with a sampling probe device and means for urging the sampling probe device into contact with the borehole wall, the sampling probe device comprising an inner probe and an outer probe surrounding the inner probe for withdrawing respective fluid samples from the formation, wherein the sampling probe device is adapted to receive any one of a plurality of inner probes each having a different flow area.

In this third aspect of the invention, said inner and outer probes are advantageously substantially circular in cross-section and substantially coaxial with each other, and each said inner probe may be adapted for screw-threaded engagement with the sampling probe device.

According to a fourth aspect of the invention, there is provided a method of sampling the formation fluids in an earth formation surrounding a borehole, the region of the formation immediately surrounding the borehole being at least partially invaded by borehole fluids, using a borehole tool which is adapted to be lowered into the borehole and which is provided with a sampling probe device and means for urging the sampling probe device into contact with the borehole wall, the sampling probe device comprising an inner probe and an outer probe surrounding the inner probe for withdrawing respective fluid samples from the formation, the method comprising adjusting the ratio between the respective flow areas of the inner and outer probes so as to tend to reduce the time taken to obtain via the inner probe a sample of the formation fluids having a given level of contamination by borehole fluids.

In a preferred implementation of this fourth aspect of the invention, the adjusting step is performed in dependence upon at least one parameter selected from the radial depth of the invaded region of the formation around the borehole, the ratio between the viscosity of the borehole fluids which have invaded the formation and the viscosity of the formation fluids, and the permeability and the anisotropy of the formations, and may comprise changing the area of the end of the inner probe in contact with the wall of the borehole.

The end of the inner probe in contact with the wall of the borehole may be deformable, in which case the changing step may comprise varying the force with which said inner probe is urged into contact with the wall of the borehole. Alternatively, the inner probe may comprises a plurality of closely-fitting, coaxially-internested, relatively slideable cylinders, and the changing step may comprise varying the number of said cylinders in contact with the formation.

According to a fifth aspect of the invention, there is provide apparatus for sampling the formation fluids in an earth formation surrounding a borehole, the region of the formation immediately surrounding the borehole being at least partially invaded by borehole fluids, the apparatus comprising a borehole tool which is adapted to be lowered into the borehole and which is provided with a sampling probe device and means for urging the sampling probe device into contact with the borehole wall, the sampling probe device comprising an inner probe and an outer probe surrounding the inner probe for withdrawing respective fluid samples from the formation, and means for adjusting the ratio between the respective flow areas of the inner and outer probes so as to tend to reduce the time taken to obtain via the inner probe a sample of the formation fluids having a given level of contamination by borehole fluids.

Advantageously, the adjusting means is operated to adjust the ratio between the respective flow areas of the inner and outer probes in dependence upon at least one parameter selected from the radial depth of the invaded region of the formation around the borehole, the ratio between the viscosity of the borehole fluids which have invaded the formation and the viscosity of the formation fluids, and the permeability and the anisotropy of the formations.

Conveniently, the adjusting means comprises means for changing the area of the end of the inner probe in contact with the wall of the borehole. Thus the end of the inner probe in contact with the wall of the borehole may be deformable, and the changing means may comprise means for varying the force with which said inner probe is urged into contact with the wall of the borehole. Alternatively, the inner probe may comprise a plurality of closely-fitting, coaxially-internested, relatively slideable cylinders, and the changing means may comprise means for varying the number of said cylinders in contact with the formation.

In another implementation of the fifth aspect of the invention, the outer probe comprises an inner region, and an outer region surrounding the inner region, for withdrawing respective fluid samples from the formation, the tool further comprising valve means selectively operable to combine the fluid sample withdrawn via said inner region of the outer probe with the fluid sample withdrawn via the inner probe.

According to a sixth aspect of the invention, there is provided apparatus for sampling the formation fluids in an earth formation surrounding a borehole, the region of the formation immediately surrounding the borehole being at least partially invaded by borehole fluids, the apparatus comprising a borehole tool which is adapted to be lowered into the borehole and which is provided with a sampling probe device and means for urging the sampling probe device into contact with the borehole wall, the sampling probe device comprising an inner probe, an intermediate probe surrounding the inner probe, and an outer probe surrounding the intermediate probe, all for withdrawing respective fluid samples from the formation, the tool further comprising valve means selectively operable to combine the fluid sample withdrawn via said intermediate probe with the fluid sample withdrawn via the inner probe.

BRIEF DESCRIPTION OF THE DRAWINGS

The invention will now be described, by way of non-limitative example only, with reference to the accompanying drawings, of which.

DETAILED DESCRIPTION OF THE INVENTION

Figure 1A:
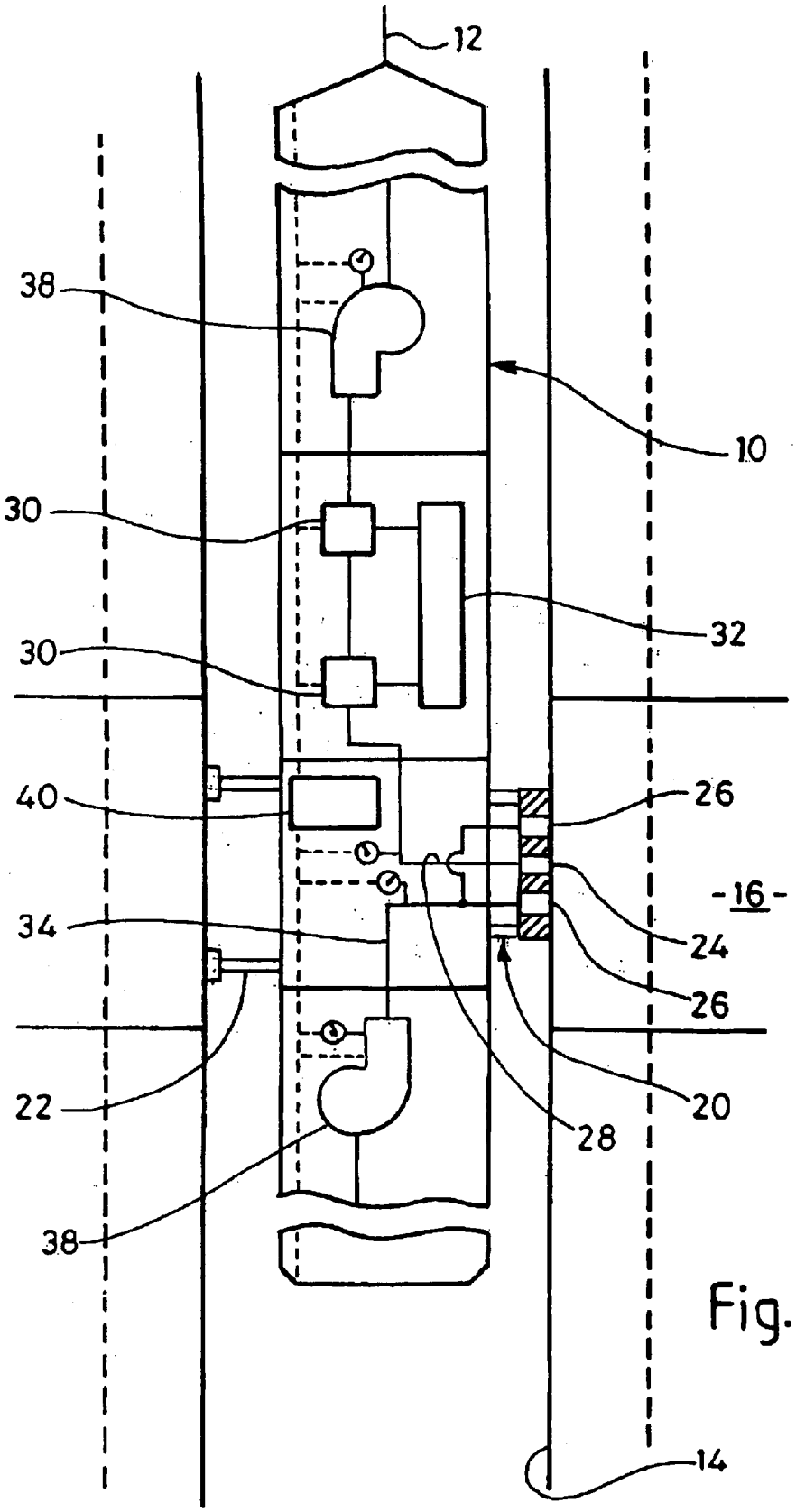
FIG. 1A is a somewhat schematic representation of apparatus in accordance with the present invention disposed in a borehole penetrating an earth formation, the apparatus comprising a borehole tool incorporating a sampling probe device through which fluid samples are withdrawn from the formation.

We have found by a combination of theory and numerical simulations that when using a borehole tool with a sampling probe device having an inner probe and an outer probe surrounding the inner probe to obtain a sample of formation fluid having a given low level of contamination by borehole fluid and filtrate (that is, borehole fluid that has seeped into the so-called invaded zone around the borehole), the time taken to obtain the sample not only varies widely with the viscosity of the filtrate and the radial extent of the invaded zone, but is also significantly affected by the ratio of the flow rate of the fluid flowing into the inner sampling probe to the total flow rate into the outer probe and the inner sampling probe. The present invention is based on the appreciation that varying this ratio in dependence upon such parameters as the relative viscosities of the formation fluid and the filtrate, the radial extent of the invaded zone, and the permeability and the anisotropy of the formation, which are often known in advance, can significantly reduce the time taken to obtain the sample.

With reference now to the drawings, the apparatus shown in FIG. 1 comprises an elongate modular borehole tool 10 suspended on a wireline or slickline 12 in a borehole 14 penetrating an earth formation 16 believed to contain exploitable, ie recoverable, hydrocarbons. Surrounding the borehole 14, to a radial distance of up to several tens of centimetres, is an invaded zone 18 of the formation 16 into which contaminants, typically filtrate from drilling mud used in the drilling of the borehole, have penetrated from the borehole.

The borehole tool 10 is provided with a sampling probe device 20 which will be described in more detail hereinafter and which projects laterally from the tool. The sampling probe device 20 is urged into firm contact with the wall of the borehole 14 adjacent the formation 16 by an anchoring device 22, which is mounted on the side of the tool 10 substantially opposite the sampling probe and which presses against the borehole wall. As will become apparent, the sampling probe device 20 includes inner and outer probes 24, 26 having respective flow areas whose ratio can be varied. The inner probe 24 is selectively connectable via an outlet conduit 28 containing a pair of changeover (or diverter) valves 30 either to a sample chamber 32 or to a dump outlet (not shown), while the outer probe 26 is coupled via an outlet conduit 34 to a dump outlet (not shown). Both of the probes 24, 26 are arranged to draw fluid samples from the formation 16, under the control of respective pumps 38 and a control system 40 which controls the valves 30 and the pumps 38. In the event it is determined that a sample of the formation having an acceptably low level of contamination can be obtained via the inner probe 24, the control system 40 operates pumps 38 to control the relative flow rates or pressures at the inner and outer probes 24, 26, and sets the valves 30 to direct the sample from the inner probe 24 into the sample chamber 32.

Figure 1B:
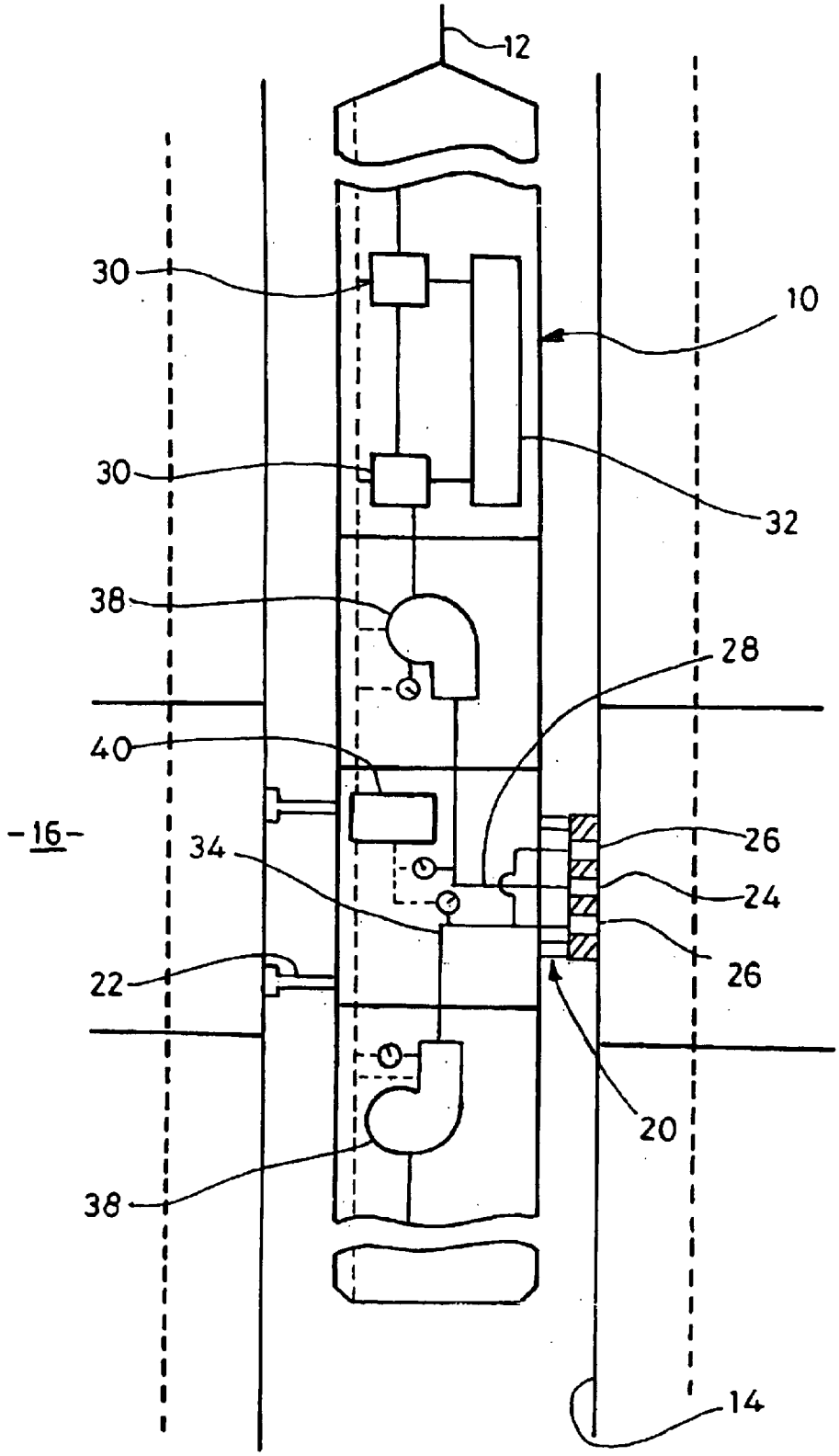
FIG. 1B shows a modification of the apparatus of FIG. 1A.

It will be appreciated that in the borehole tool 10 of FIG. 1A, fluid is drawn into the sample chamber 32 without passing through the relevant pump 38. In the modification of Figure of FIG. 1B, the fluid passes through the relevant pump 38 en route to the sample chamber. Other modifications which can be made include using a single pump in place of the two pumps 38, and providing the conduit 34 with valves and a sample chamber analogous to the valves 30 and sample chamber 32, so that the fluid obtained via the outer probe 26 can be selectively retained or dumped, rather than always dumped.

Figure 2:
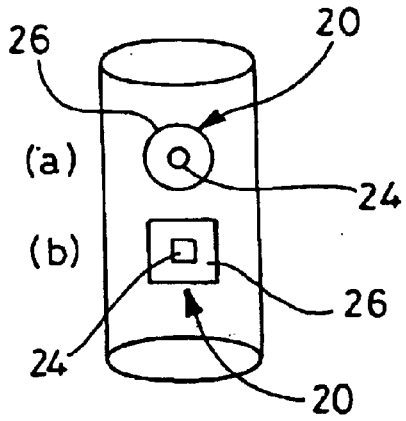
FIG. 2 shows at (*a*) and (*b*) alternative forms of the end of the sampling probe device of FIGS. 1A and 1B which is urged into contact with the formation and through which the samples flow into the borehole tool.
Figure 3:
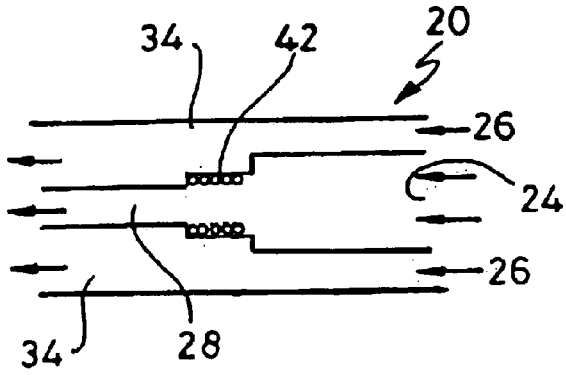
FIG. 3 is a sectional view of a preferred implementation of the sampling probe device of FIG. 2(*a*)

As can be seen in FIG. 2, the inner and outer probes 24, 26 of the sampling probe device 20 can be either circular and concentric, with the outer probe completely surrounding the inner probe, as shown in FIG. 2(*a*), or rectangular, again with the outer probe completely surrounding the inner probe, as shown in FIG. 2(*b*). FIG. 3 shows a preferred implementation of the sampling probe device of FIG. 2(*a*), in which the inner probe 24 is replaceable by virtue of having a screw-threaded connection 42 with the end of its conduit 28, so that the aforementioned variable flow area ratio feature can be achieved simply by changing the inner probe 24 for one having a different diameter. It will be appreciated that the outer wall of the outer probe 26 can alternatively or additionally be made replaceable by use of a similar screw-threaded connection with the outer wall of its conduit 34, thus permitting the range of variation of the flow area ratio to be widened. In another implementation, the whole probe device 20 can be made replaceable, so that the variable flow are feature is achieved by selecting one of several sampling probe devices 20 each having inner and outer probes of different flow area ratio.

Figure 4:
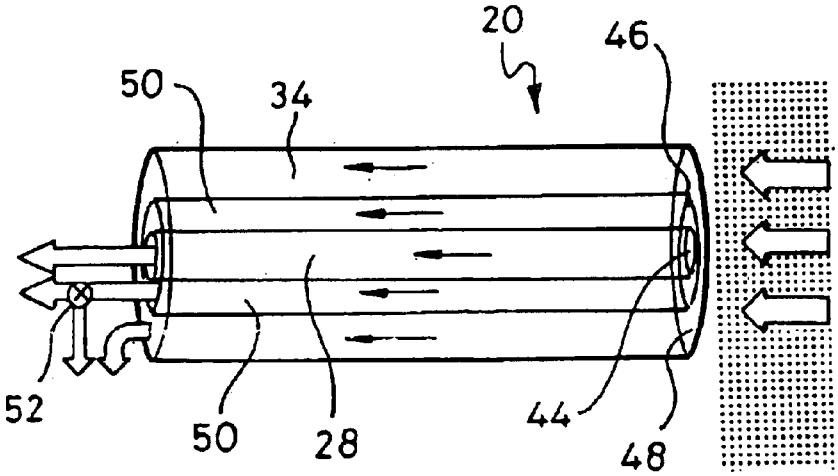
FIGS. 4 and 5 are schematic representations of an alternative implementation of the sampling probe device of FIGS. 1A and 1B.
Figure 5:
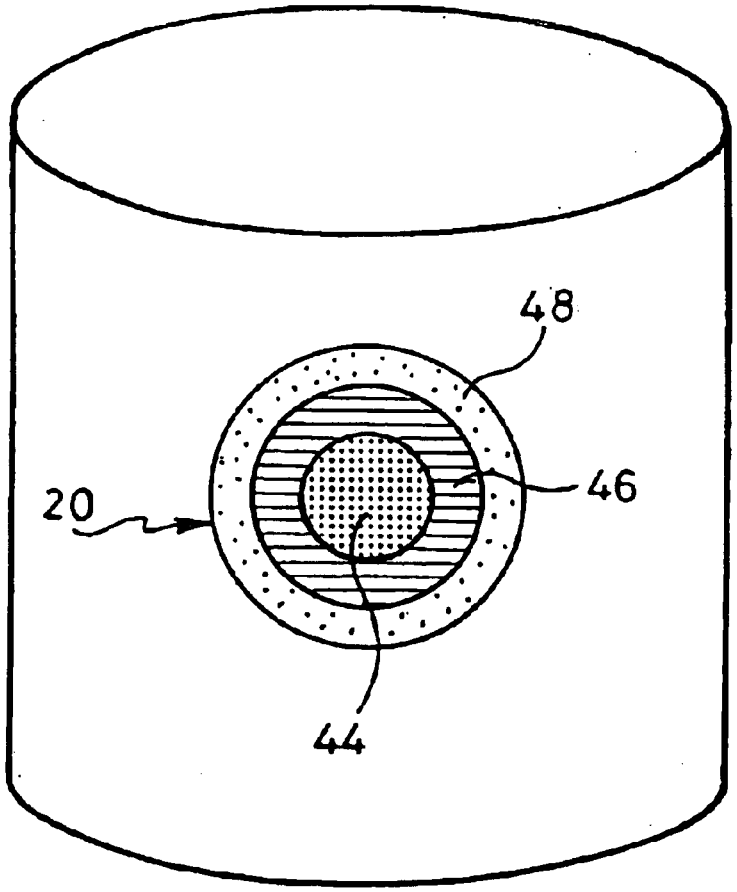

The alternative implementation of the sampling probe device 20 shown in FIGS. 4 and 5 comprises inner, intermediate and outer probes 44, 46 and 48, which are substantially circular and concentric with each other. The intermediate probe 46 completely surrounds the inner probe 44, while the outer probe 48 completely surrounds the intermediate probe 46. All three of the probes 44, 46, 48 withdraw fluid samples from the formation 16 under the control of the pump 38 and the control system 40 of FIG. 1, but the outlet conduit 50 of the intermediate probe includes a valve 52, also controlled by the control system 40, by which the fluid sample withdrawn via the intermediate probe 46 can be selectively combined either with the sample in the conduit 28 from the inner probe 44, or with the sample in the conduit 34 from the outer probe 48. It will be appreciated that these alternatives are equivalent to increasing the flow area of the inner probe 44 by the flow area of the intermediate probe 46 on the one hand, and increasing the flow area of the outer probe 48 by the flow area of the intermediate probe 46 on the other hand, thus achieving the aforementioned variable flow area ratio mentioned earlier.

Figure 6:
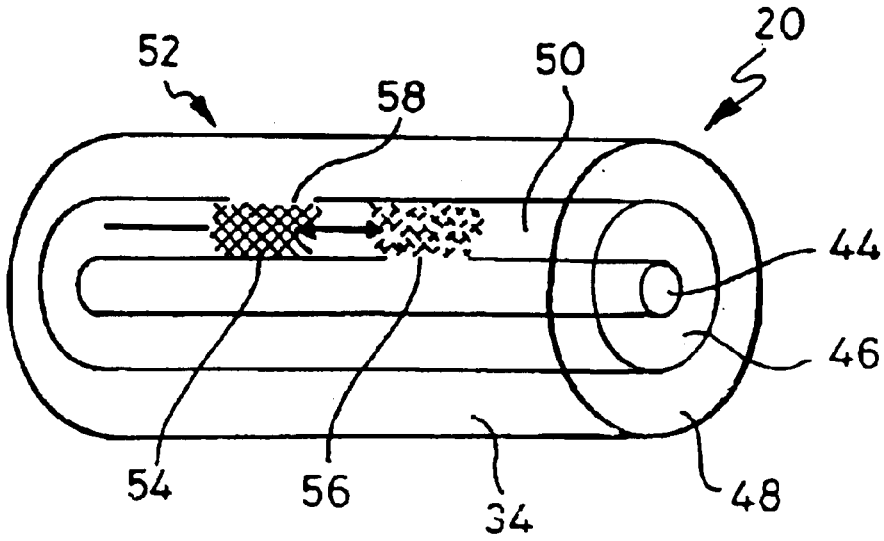
FIG. 6 shows a preferred implementation of the probe sampling device of FIGS. 4 and 5.

One way of implementing the valve 52 of the sampling probe device 20 of FIGS. 4 and 5 is shown in FIG. 6. Thus the conduits 28, 50 and 34 of the probes 44, 46 and 48 respectively are coaxially internested, and a shuttle valve member 54 is axially movable in the conduit 50 between a first position, in which it opens a port 56 between the conduit 50 and the conduit 28 while closing a port 58 between the conduit 50 and the conduit 34, and a second position, in which it closes the port 56 and opens the port 58.

It will be appreciated that the principles underlying the probe sampling device 20 of FIGS. 4 to 6, which provides two different flow area ratios, can readily be extended by using more than three concentrically arranged probes communicating with a corresponding number of coaxially internested outlet conduits and having an appropriate number of shuttle or other switchover valves. And although it is convenient for the probes and their outlet conduits to be circular in section, it is not essential: as already described, rectangular sections can also be used.

FIGS. 7 to 13, each of which is made up of four separate figures referenced (*a*), (*b*), (*c*) and (*d*), show different implementations of variable area probes, each of which can be used as the inner probe 24 of the sampling probe device 20 of FIG. 1 (as shown), and/or as the outer probe 26.

Figures 7A, 7B, 7C, 7D:
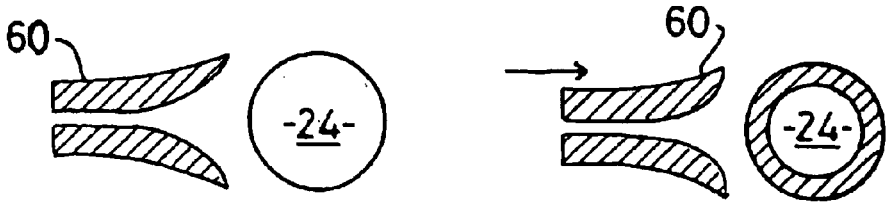
FIGS. 7 to 13 illustrate different implementations of variable area probes which can be incorporated into the sampling probe device of FIGS. 1A and 1B.

Thus the probe 24 of FIG. 7 comprises a tube 60 made of a soft deformable compound, and is shown undeformed in FIG. 7(*a*), with its flow area in its undeformed state shown in FIG. 7(*b*). Applying an axial force to the tube 60 to press it more firmly against the borehole wall deforms the probe and reduces its flow area as shown in FIGS. 7(*c*) and 7(*d*) respectively. The axial force can be applied by any suitable mechanism, eg a mechanical, electromechanical or hydraulic mechanism.

Figures 8A, 8B, 8C, 8D:
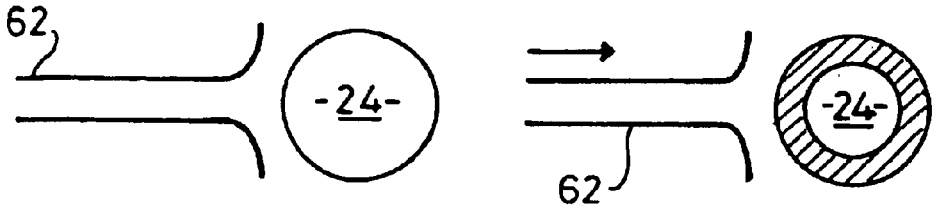

The probe 24 of FIG. 8 comprises a tube 62 made from a semi-stiff deformable material which is thinner than the material of the probe of FIG. 7. Otherwise, its mode of use is basically similar to that of the FIG. 7 probe, and the views of FIGS. 8(*a*) to 8(*d*) correspond to those of FIGS. 7(*a*) to 7(*d*).

Figures 9A, 9B, 9C, 9D:
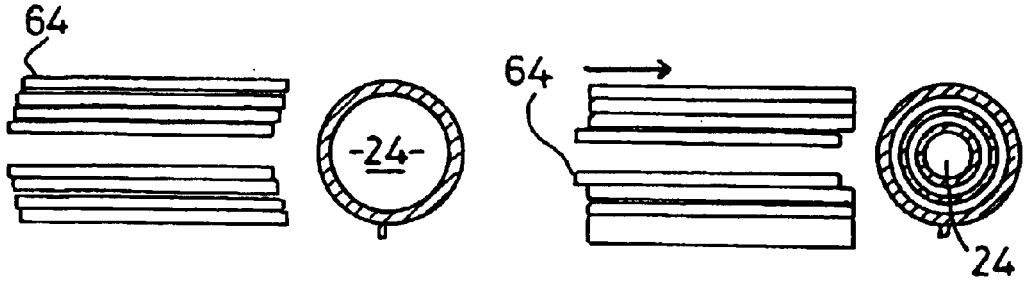
Figure 10A:
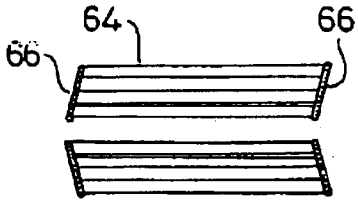
Figure 10B:
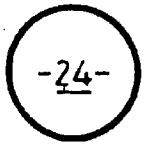
Figure 10C:
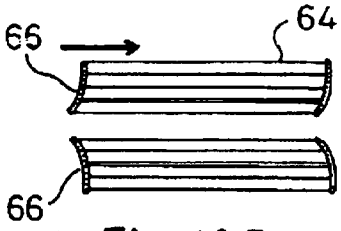
Figure 10D:
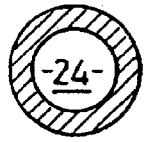
Figure 11A:
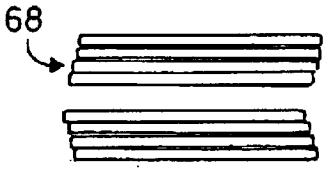
Figure 11B:
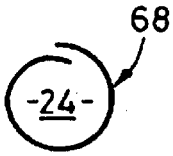
Figure 11C:
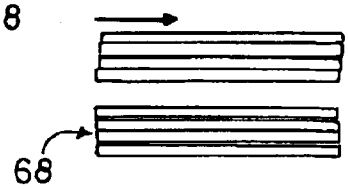
Figure 11D:
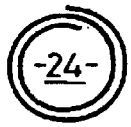
Figure 12A:
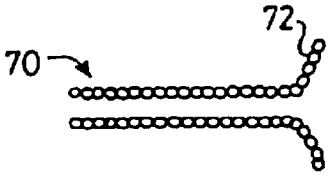
Figure 12B:
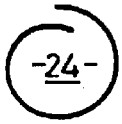
Figure 12C:
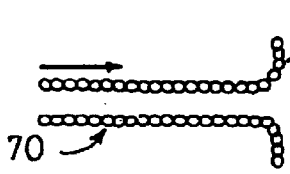
Figure 12D:
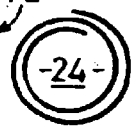
Figure 13A:
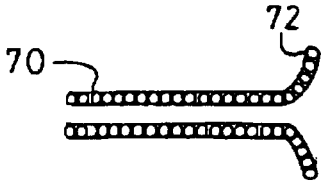
Figure 13B:
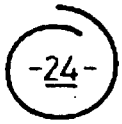
Figure 13C:
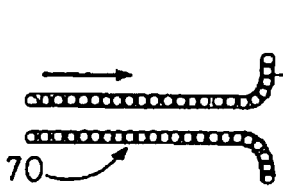
Figure 13D:
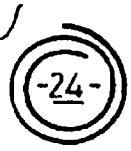

The probe 24 of FIG. 9 comprises an array of close-fitting coaxially-internested cylinders 64, which are arranged such that an increasing axial force progressively increases the number of them, from the outer one towards the inner one, in contact with the borehole wall, thus progressively decreasing the flow area of the probe. The maximum flow area state of the probe is shown in FIGS. 9(*a*) and 9(*b*), while a reduced flow area state is shown in FIGS. 9(*c*) and 9(*d*).

FIG. 10 shows a variation of the FIG. 9 probe, in which the cylinders 64 are coupled together at each of their ends 66, but which otherwise operates in substantially the same manner.

The probe 24 of FIG. 11 comprises a single spirally-wound cylinder 68, whose staggered inner turns respond to an axial force in a manner analogous to the interested cylinders of FIGS. 9 and 10. Again, the maximum flow area state of the probe is shown in FIGS. 11(*a*) and 11(*b*), while a reduced flow area state is shown in FIGS. 11(*c*) and 11(*d*).

FIGS. 12 and 13 show probes 24 both made from a cylindrical tightly coiled spring 70 with a trumpet-shaped end 72 for contacting the borehole wall: in the former, the spring has a flat coil at its borehole contact end, while in the latter, the spring is potted in a suitable elastomer. In both cases, axial force increases the number of coils of the spring in contact with the borehole wall, so decreasing the flow area of the probe.

Several modifications can be made to the described embodiments of the invention.

For example, the inner and outer probes need not be circular or rectangular in section, but can be elliptical, ellipsoidal, polygonal or any other convenient shape, or even different from each other, as long as the outer probe surrounds the inner probe. In practice, the geometry of the probes is typically selected in dependence upon such parameters as the depth of invasion of the filtrate, the ratio between the viscosity of the filtrate and the viscosity of the formation fluids, and the permeability and anisotropy of the formations.

What is claimed is:

1. A method of sampling the formation fluids in an earth formation surrounding a borehole, the region of the formation immediately surrounding the borehole being at least partially invaded by borehole fluids, said method comprising the steps of lowering a borehole tool with a sampling probe device into the borehole; urging the sampling probe device into contact with the borehole wall and withdrawing fluid samples from the formation, the sampling probe device comprising an inner probe and an outer probe surrounding the inner probe for withdrawing respective fluid samples from the formation, said method further comprising the step of selecting the ratio between the respective flow areas of the inner and outer probes so as to tend to reduce the time taken to obtain via the inner probe a sample of the formation fluids having a given level of contamination by borehole fluids.

2. A method as claimed in claim 1, wherein the selecting step is performed in dependence upon at least one parameter selected from the radial depth of the invaded region of the formation around the borehole, the ratio between the viscosity of the borehole fluids which have invaded the formation and the viscosity of the formation fluids, and the permeability and the anisotropy of the formations.

3. A method as claimed in claim 1, wherein the selecting step comprises adapting the tool to receive interchangeable sampling probe devices, and choosing the sampling probe device from among a plurality of sampling probe devices each having a different value of said ratio.

4. A method as claimed in claim 1, wherein the selecting step comprises adapting the sampling probe device to receive interchangeable inner probes, and choosing the inner probe from among a plurality of inner probes each having a different flow area.

5. Apparatus for sampling the formation fluids in an earth formation surrounding a borehole, the region of the formation immediately surrounding the borehole being at least partially invaded by borehole fluids, the apparatus comprising a borehole tool adapted to be lowered into the borehole, the tool being adapted to receive any one of a plurality of interchangeable sampling probe devices and including means for urging a received sampling probe device into contact with the borehole wall, each sampling probe device comprising an inner probe and an outer probe surrounding the inner probe for withdrawing respective fluid samples from the formation, the ratio between the respective flow areas of the inner and outer probes being different for each sampling probe device.

6. Apparatus for sampling the formation fluids in an earth formation surrounding a borehole, the region of the formation immediately surrounding the borehole being at least partially invaded by borehole fluids, the apparatus comprising a borehole tool which is adapted to be lowered into the borehole and which is provided with a sampling probe device and means for urging the sampling probe device into contact with the borehole wall, the sampling probe device comprising an inner probe and an outer probe surrounding the inner probe for withdrawing respective fluid samples from the formation, wherein the sampling probe device is adapted to receive any one of a plurality of inner probes each having a different flow area.

7. Apparatus as claimed in claim 6, wherein said inner and outer probes are substantially circular in cross-section and substantially coaxial with each other.

8. Apparatus as claimed in claim 6, wherein said inner and outer probes are substantially elliptical or ellipsoidal in cross-section.

9. Apparatus as claimed in claim 6, wherein said inner and outer probes are substantially polygonal in cross-section.

10. Apparatus as claimed in claim 6, wherein each of said inner probes is adapted for screw-threaded engagement with the sampling probe device.

11. A method of sampling the formation fluids in an earth formation surrounding a borehole, the region of the formation immediately surrounding the borehole being at least partially invaded by borehole fluids, using a borehole tool which is adapted to be lowered into the borehole and which is provided with a sampling probe device and means for urging the sampling probe device into contact with the borehole wall, the sampling probe device comprising an inner probe and an outer probe surrounding the inner probe for withdrawing respective fluid samples from the formation, the method comprising adjusting the ratio between the respective flow areas of the inner and outer probes so as to tend to reduce the time taken to obtain via the inner probe a sample of the formation fluids having a given level of contamination by borehole fluids.

12. A method as claimed in claim 11, wherein the adjusting step is performed in dependence upon at least one parameter selected from the radial depth of the invaded region of the formation around the borehole, the ratio between the viscosity of the borehole fluids which have invaded the formation and the viscosity of the formation fluids, and the permeability and the anisotropy of the formations.

13. A method as claimed in claim 11, wherein the adjusting step comprises changing the area of the end of the inner probe in contact with the wall of the borehole.

14. A method as claimed in claim 13, wherein the end of the inner probe in contact with the wall of the borehole is deformable, and the changing step comprises varying the force with which said inner probe is urged into contact with the wall of the borehole.

15. A method as claimed in claim 13, wherein the inner probe comprises a plurality of closely-fitting, coaxially-internested, relatively slideable cylinders, and the changing step comprises varying the number of said cylinders in contact with the formation.

16. Apparatus for sampling the formation fluids in an earth formation surrounding a borehole, the region of the formation immediately surrounding the borehole being at least partially invaded by borehole fluids, the apparatus comprising a borehole tool which is adapted to be lowered into the borehole and which is provided with a sampling probe device and means for urging the sampling probe device into contact with the borehole wall, the sampling probe device comprising an inner probe and an outer probe surrounding the inner probe for withdrawing respective fluid samples from the formation, and means for adjusting the ratio between the respective flow areas of the inner and outer probes so as to tend to reduce the time taken to obtain via the inner probe a sample of the formation fluids having a given level of contamination by borehole fluids.

17. Apparatus as claimed in claim 16, wherein the adjusting means is operated to adjust the ratio between the respective flow areas of the inner and outer probes in dependence upon at least one parameter selected from the radial depth of the invaded region of the formation around the borehole, the ratio between the viscosity of the borehole fluids which have invaded the formation and the viscosity of the formation fluids, and the permeability and the anisotropy of the formations.

18. Apparatus as claimed in claim 16, wherein the adjusting means comprises means for changing the area of the end of the inner probe in contact with the wall of the borehole.

19. Apparatus as claimed in claim 18, wherein the end of the inner probe in contact with the wall of the borehole is deformable, and the changing means comprises means for varying the force with which said inner probe is urged into contact with the wall of the borehole.

20. Apparatus as claimed in claim 19, wherein the inner probe comprises a plurality of closely-fitting, coaxially-internested, relatively slideable cylinders, and the changing means comprises means for varying the number of said cylinders in contact with the formation.

21. Apparatus as claimed in claim 16, wherein the outer probe comprises an inner region and an outer region surrounding the inner region for withdrawing respective fluid samples from the formation, the tool further comprising valve means selectively operable to combine the fluid sample withdrawn via said inner region of the outer probe with the fluid sample withdrawn via the inner probe.

22. Apparatus for sampling the formation fluids in an earth formation surrounding a borehole, the region of the formation immediately surrounding the borehole being at least partially invaded by borehole fluids, the apparatus comprising a borehole tool which is adapted to be lowered into the borehole and which is provided with a sampling probe device and means for urging the sampling probe device into contact with the borehole wall, the sampling probe device comprising an inner probe, an intermediate probe surrounding the inner probe, and an outer probe surrounding the intermediate probe, all for withdrawing respective fluid samples from the formation, the tool further comprising valve means selectively operable to combine the fluid sample withdrawn via said intermediate probe with the fluid sample withdrawn via the inner probe.

* * * * *